US005638882A

United States Patent [19]

Morris

[11] Patent Number: 5,638,882

[45] Date of Patent: Jun. 17, 1997

[54] VENETIAN BLIND LADDER CARRIER MECHANISM

[75] Inventor: Jonhn E. Morris, Lake Mills, Wis.

[73] Assignee: Springs Window Fashions Division, Inc., Middleton, Wis.

[21] Appl. No.: 681,533

[22] Filed: Jul. 23, 1996

[51] Int. Cl.[6] ..... E06B 9/26

[52] U.S. Cl. ..... 160/176.1

[58] Field of Search ..... 160/168.1 R, 170 R, 160/171 R, 172 R, 176.1 R, 177 R, 178.1 R

[56] References Cited

U.S. PATENT DOCUMENTS

| | | | |
|---|---|---|---|
| 3,918,513 | 11/1975 | Englund et al. . | |
| 4,494,593 | 1/1985 | Fidler, Jr. . | |
| 4,697,629 | 10/1987 | Anderson | 160/177 R |
| 5,341,865 | 8/1994 | Fraser et al. . | |

*Primary Examiner*—David M. Purol
*Attorney, Agent, or Firm*—Lathrop & Clark

[57] ABSTRACT

A venetian blind ladder carrier mechanism for connecting the slat support ladders of a venetian blind to a tilt rod. The ladder carrier mechanism includes a drive member connected to the tilt rod for turning with the tilt rod and, first and second carrier members supported for turning relative to the drive members and relative to each other about a the axis of the tilt rod. The first and second carrier members have respective first and second ladder supports spaced outwardly from the axis of the tilt rod and connected to respective ones of the side strips of the ladder. The drive member is arranged to drive the first carrier member in a first angular direction when the drive member is rotated in the first angular direction by the tilt rod to lift one of the side strips of the ladder and the drive member is arranged to drive the second carrier member in a second angular direction when the drive member is rotated in the second angular direction by the tilt rod and raise the other side strip of the ladder.

19 Claims, 6 Drawing Sheets

22c
21
32
25
22
34a
52a
34
2
43
33a
41
22b
51a
33
31c
2
31
22a
22d
31a
31b
24a
24
23c
23
23c

FIG. 4
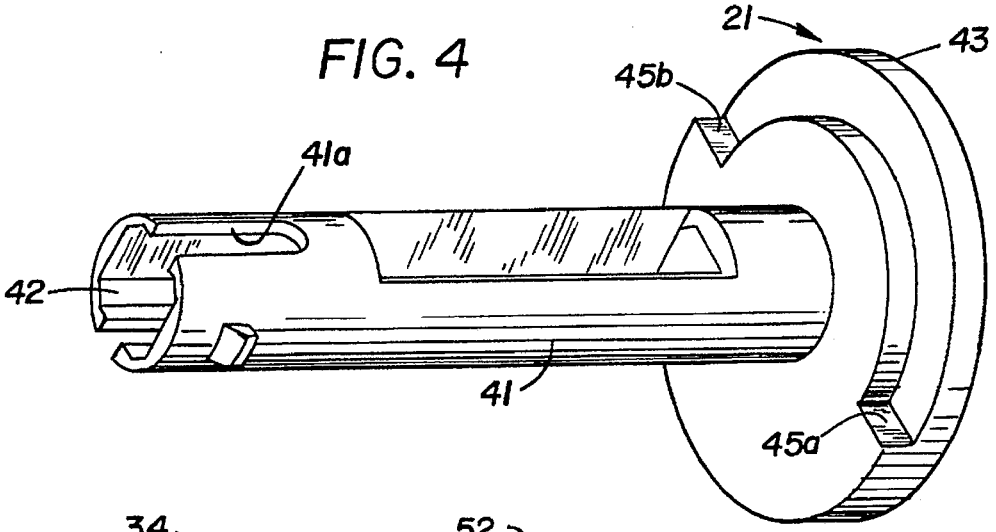
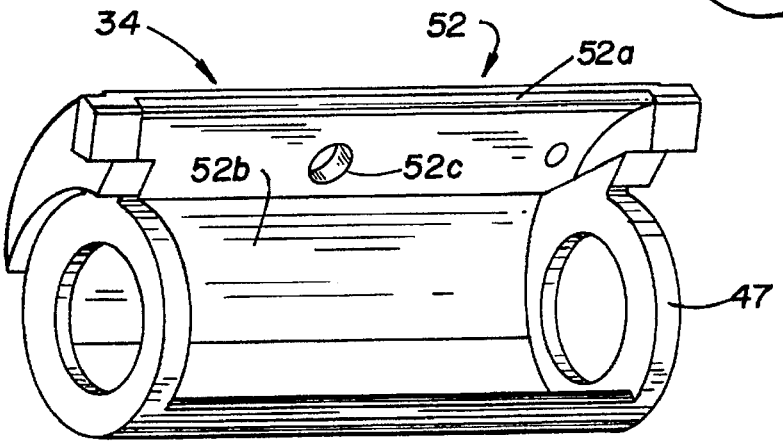
FIG. 5
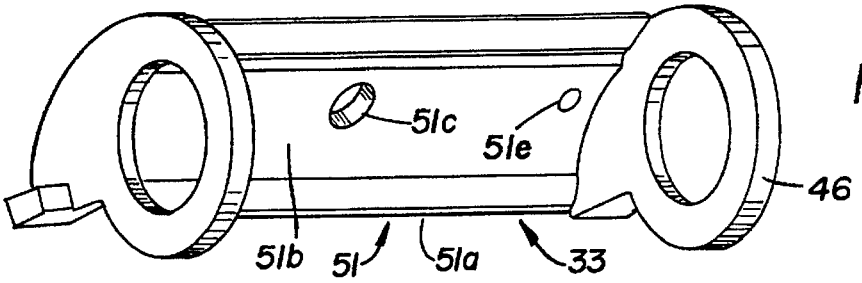
FIG. 6
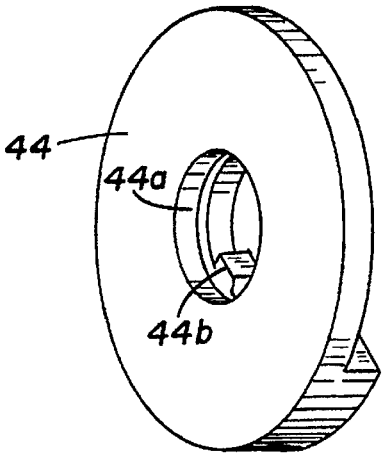
FIG. 7

VENETIAN BLIND LADDER CARRIER MECHANISM

BACKGROUND OF THE INVENTION

Venetian blinds typically comprise a plurality of horizontal slats suspended beneath a headrail by two or more flexible ladders. The ladders each include a pair of vertically extending side tapes interconnected by a plurality of vertically spaced slat supporting rungs, and the upper ends of the ladders are attached to a ladder carrier or tilt drum to tilt the slats in response to turning of the ladder carrier. In order to equalize motion of the several ladders, the ladder carriers for the several ladders are rotated in unison by a tilt rod.

In order to move the venetian blind slats between an open position in which the slats are disposed in a generally horizontal plane and a closed position in which the slats are disposed at a shallow angle to a vertical plane, it is necessary that the tilt drum or ladder supports, be capable of moving the side strips of the ladders relative to each other through a distance approximating the width of the slats. Some tape drums, for example as disclosed in U.S. Pat. Nos. 4,494,593 and 5,341,865 are formed with an oblong cross-section and arrange the ladder side strips on the drum so that the major transverse dimension of the drum is generally horizontal when the blind is open and generally vertical when the blind is closed. With such tape drums, the headrail must have a height sufficiently greater than the major transverse dimension of the drum, to not only accommodate turning of the drum, but also provide space below the drum for lift cords used for raising and lowering the blind. The tape drums in some other blinds such as disclosed in U.S. Pat. No. 3,918,513, wrap the upper ends of the side strips of the ladder in relatively opposite directions and through one or more wraps around a small diameter drum so that the drum can be turned through more than 180 degrees to raise one of the ladder side strips while lowering the other of the ladder side strips between a blind open and a blind closed position. If the drum has a small diameter as compared to the width of the slats, then the upper portions of the ladder tapes converge at an acute angle above the upper slat. This tends to cause the upper slat to hang-up in a tilted condition when the tape drum is operated from a blind closing position to a blind opening. Further, the drum limits the minimum space between the ladder side strips when in the blind closing position and inhibits full closing of the slats.

Prior ladder supports generally raise one ladder side strip and lower the other ladder side strip by equal amounts, when moving the blind between an open condition and a closed condition. With such ladder supports, a light gap commonly occurs between the upper edge of the slat and the under side of the headrail, when the blind is in a closed condition.

SUMMARY OF THE INVENTION

It is an object of the present invention to overcome the disadvantages of the prior art by providing a ladder support mechanism for a venetian blind which reduces the vertical height of the headrail required to accommodate movement of the ladder support mechanism between a blind open condition and a blind closed condition, which avoids hang-up of the upper slat of the blind in a tilted condition when the blind is moved to an open condition, which allows tight closing of the slats, and which minimizes a light gap between the upper slat and the headrail, when the blind is in a closed condition.

Accordingly, the invention provides a ladder carrier mechanism for connecting the slat support ladders of a venetian blind to a tilt rod for operation thereby, wherein the ladder carrier mechanism comprises a drive means connected to the tilt rod for turning therewith about the axis of the tilt rod, first and second carrier members supported for turning relative to the drive means and relative to each other about the axis of the tilt rod, the first and second carrier members have first and second ladder support means spaced outwardly from the axis of the tilt rod, means connecting one of the side strips of the ladder to the first ladder support means and means connecting the other of the side strips of the ladder to the second ladder support means, and means on the drive means for driving the first carrier member in a first angular direction when the drive means is rotated in the first angular direction by the tilt rod, and means on the drive means for driving the second carrier member in a second angular direction when the drive means is rotated in the second angular direction by the tilt rod.

The drive means has first and second drive lugs angularly spaced apart about 180 degrees and the first carrier member has a first abutment disposed in the path of the first drive lug when the drive means is rotated in a first direction, and the second carrier member has a second abutment disposed in the path of movement of the second drive lug when the drive means is rotated in a second direction. Thus, when the drive means is rotated in a selected direction, one drive lug engages an abutment on one carrier member and rotates that carrier member in a direction to lift the side strip connected to that carrier member while and the other carrier member allows the other side strip to move downwardly under the weight of the venetian blind.

The drive member can rotate the carrier members in their respective first and second directions through an angle substantially greater than 180 degrees while the other carrier member allows the other side strip of the ladder to move downwardly under the weight of the venetian blind to a position in which the other side strip is disposed below the tilt rod axis. Thus, when the drive means is rotated in one direction, the drive means can rotate one carrier member through an angle greater than 180 degrees and lift the side strip on one side of the ladder through a distance greater than the side strip on the other side of the ladder is lowered. The ladder support members on the first and second carrier members have strip suspension edges spaced outwardly from their axis a distance such that the side strips of the ladder extend downwardly at a shallow angle to the vertical, when the tape suspension edges are disposed in a generally horizontal plane, to minimize the likelihood of causing the upper slat to hang up in a tilted position when the ladder carrier mechanism is operated between a slat closing position and a slat opening position. The ladder supports on the first and second carrier members are advantageously configured to converge inwardly from the associated strip suspension edge in a direction opposite the direction of rotation of the carrier means by the drive means, to allow the side strips of the ladder to move sufficiently close to tightly close the slats, when the ladder carrier mechanism is operated to close the slats.

BRIEF DESCRIPTION OF THE DRAWING

FIG. 4 is a perspective view of the drive means for the ladder carrier mechanism;

FIG. 5 is a perspective view of one of the carrier members;

FIG. 6 is a perspective view of a second of the carrier members;

FIG. 7 is a perspective view of a second part of the drive means;

DETAILED DESCRIPTION

The present invention relates to improvements in venetian blinds. Venetian blinds are typically comprised of a plurality of horizontal slats suspended beneath a headrail by at least two slat ladders having their upper ends connected to ladder tilt mechanism in the headrail and the tilt mechanism is operated by a tilt rod that extends longitudinally of the headrail and interconnects the ladder carrier mechanisms for the several ladders to synchronize movement of the ladders and control tilting of the slats. As is conventional, tilt rod drive mechanism (not shown), such as a cord and pulley arrangement or a gear drive, is provided, adjacent one end of the headrail, for selectively rotating the tilt rod in opposite directions to open and close the blind.

Figure 1:
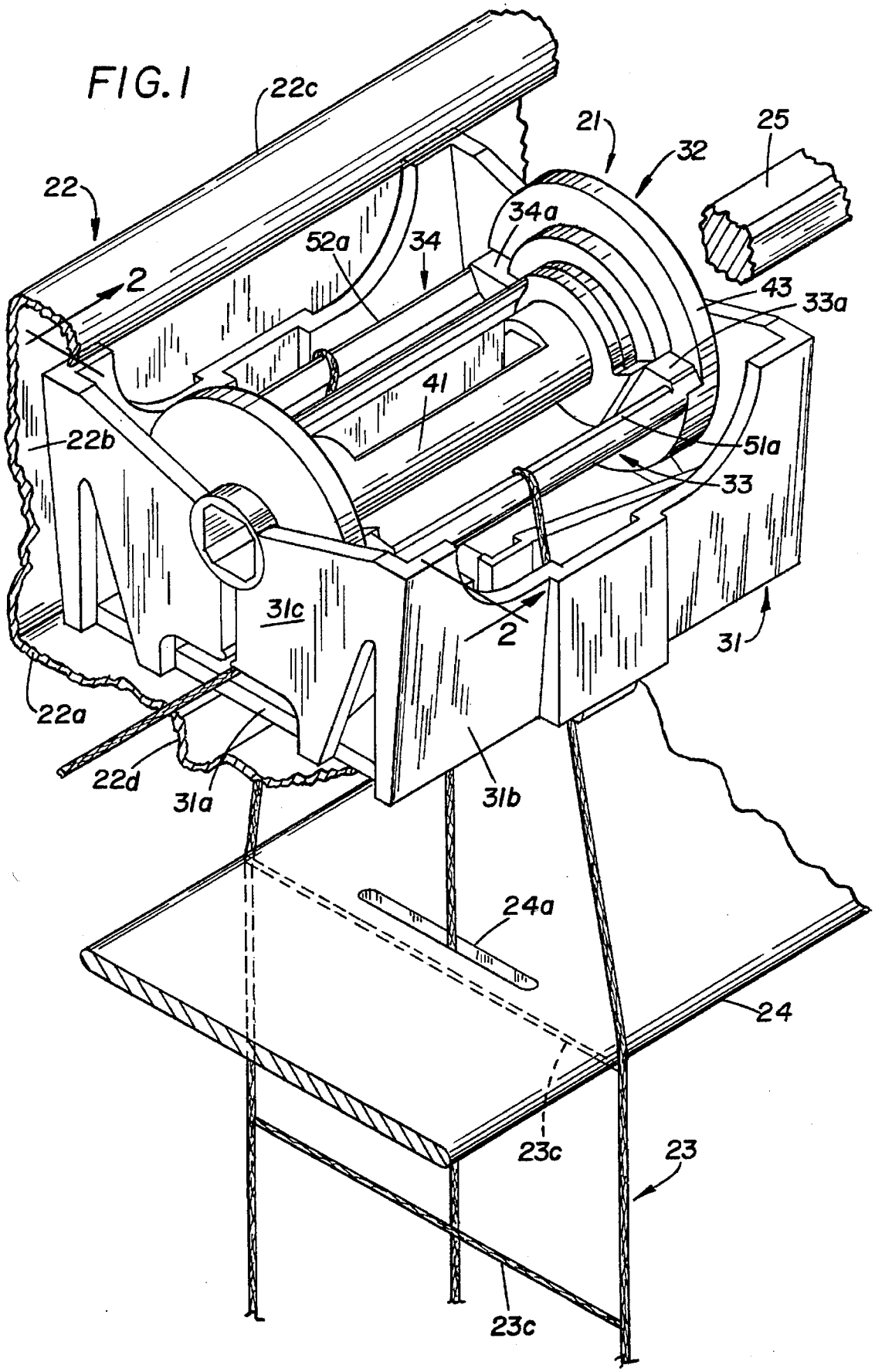
FIG. 1 is fragmentary perspective view illustrating the ladder carrier mechanism mounted in a headrail of a venetian blind.
Figure 2:
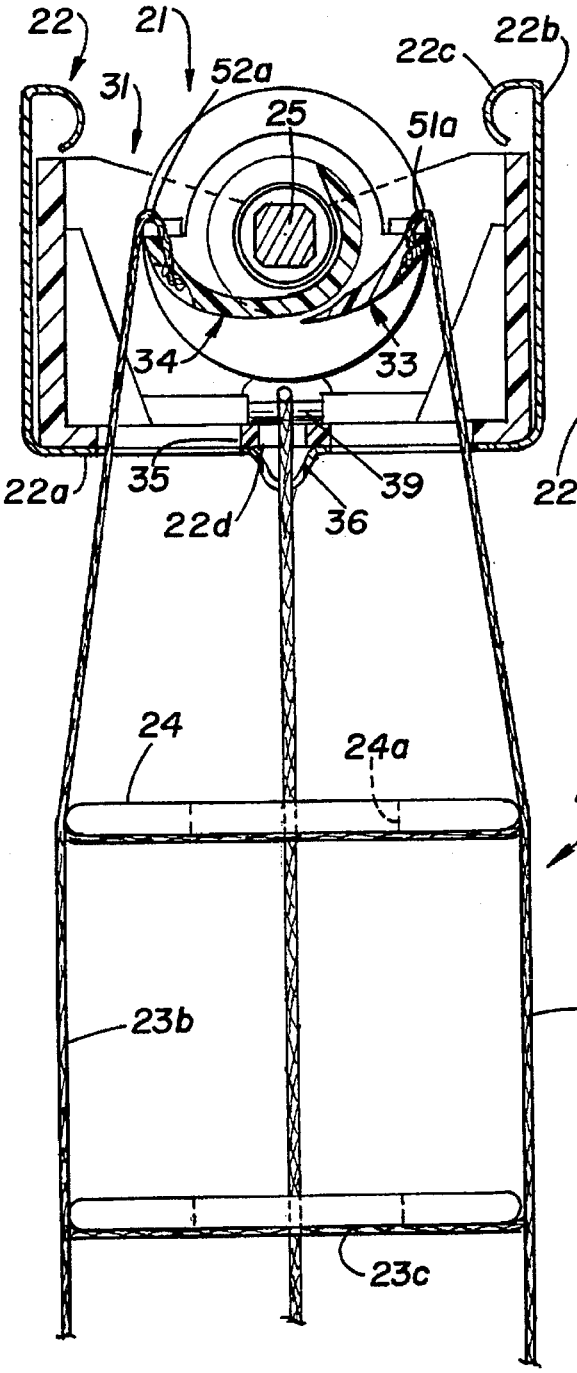
FIG. 2 is a sectional view taken on the plane 2—2 of FIG. 1.
Figure 3:
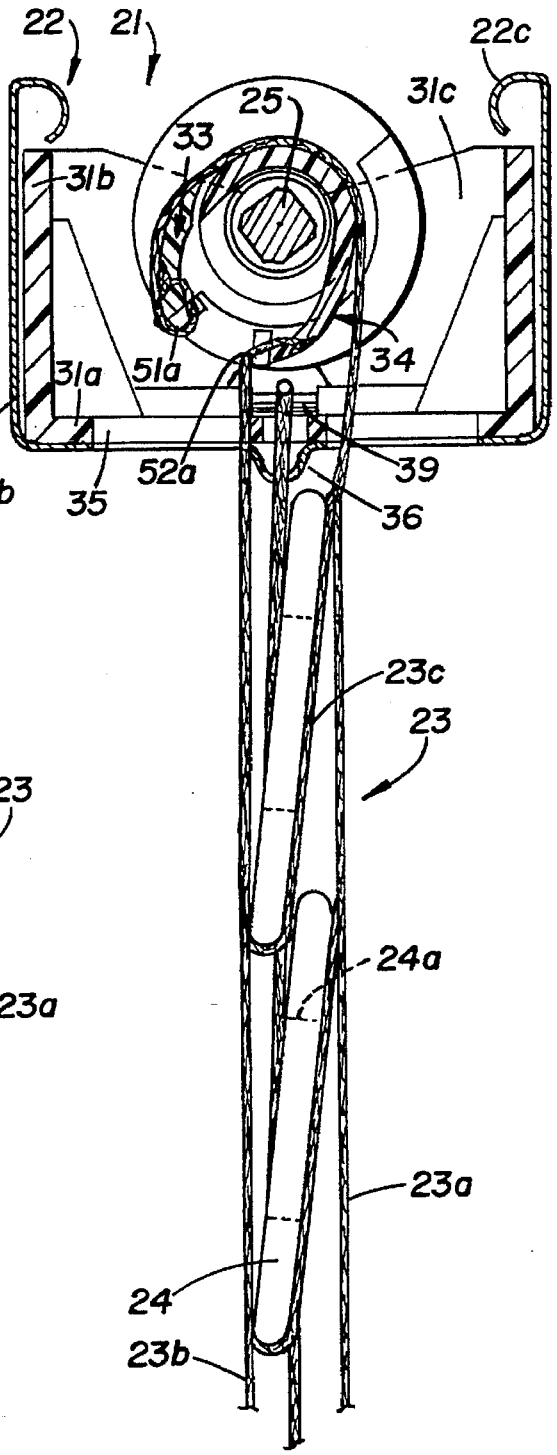
FIG. 3 is a sectional view taken on the plane 2—2 of FIG. 1 and illustrating the ladder carrier mechanism and ladder in a moved condition.
Figure 8:
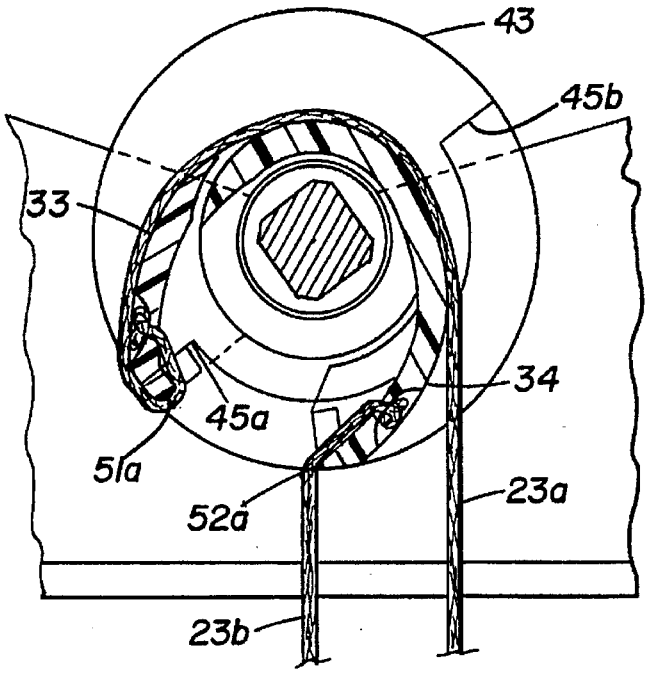
FIG. 8 is a fragmentary vertical sectional view through the ladder carrier mechanism illustrating parts on a larger scale than FIG. 2.

The present invention relates to an improved ladder carrier mechanism 21 for a venetian blind and as shown in FIGS. 1–3 mounted in a headrail 22 and connected to the upper end of a slat support ladder 23, it being understood that one ladder carrier mechanism is provided for each slat support ladder. These slat support ladders 23 include flexible side strips 23*a* and 23*b*, and cross-rungs 23*c* for supporting slats 24. As is conventional, the rungs 23*c* have a length corresponding to width of the slats 24 and the rungs are spaced apart a distance slightly less than the width of the slats so that the slats overlap to provide a tight closure when the blind is closed as shown in FIG. 3. The ladder carriers may be of the type in which the side strips 23*a*, 23*b* are formed of flexible cords as shown in FIGS. 1–3, or of tapes or ribbons, and the phrase side strips as used herein is intended to include ladders formed with either cords or tapes or ribbons of flexible material. As shown in FIGS. 1–3, the headrail includes a bottom wall 22*a*, side walls 22*b* extending upwardly from the bottom wall, and inwardly turned upper edges 22*c* on the side walls.

The ladder carrier mechanisms 21 each include a carrier support bracket 31 dimensioned to be received in the headrail, drive means 32 supported in the carrier support bracket for rotation with a tilt rod 25 about an axis extending lengthwise of the headrail, and first and second carrier members 33 and 34 supported for turning relative to the drive means 32 and relative to each other about the axis of the tilt rod. Upper end portions of the side strips 23*a* and 23*b* are attached to the first and second ladder supports in a manner described more fully thereafter. The carrier support bracket 31 includes a bottom 31*a*, upstanding sides 31*b* and ends 31*c*. Openings 35 are provided in the bottom 31*a* of a size to allow passage of the side strips 23*b* upwardly therethrough and to accommodate movement of the side strips crossswise of the headrail between the blind open position shown in FIG. 2 and the blind closed position shown in FIG. 3. Openings 36 are also provided in the bottom 31*a* substantially equidistant from the side walls 31*b* to allow passage of a lift cord 38 therethrough. As is conventional, the lift cords are attached at a lower end to a bottom rail (not shown) and pass upwardly through lift cord openings 24*a* in the slats 24, through openings 36 and over a lift cord guide roller 39 on the carrier support bracket and then lengthwise of the headrail.

As best shown in FIGS. 4 and 7, the drive means 21 includes a sleeve 41 having a polygonal opening 42 for non-rotatably receiving the tilt rod 25, and drive members 43 and 44 adjacent opposite ends of the sleeve 41. In the embodiment of FIGS. 1–10, one of the drive members 43 is formed integrally with the sleeve adjacent one end and the other of the drive members 44 is detachably and non-rotatably connected to the sleeve adjacent its other end. As shown in FIGS. 4 and 7, drive member 44 has an opening 44*a* for receiving the sleeve 41, and a projection 44*b* that extends into a slot 41*a* in the sleeve. At least one and preferably both of the drive members 43 and 44 have first and second drive lugs 45*a* and 45*b* on their inner faces that are rotatable with the respective drive member and are angularly spaced apart approximately 180 degrees.

The first and second carrier members 33 and 34 are disposed between the drive members 43 and 44. Carrier member 33 has hub portions 46 adjacent opposite ends for receiving and rotatably supporting the first carrier member on the sleeve 41 and the second carrier member 34 has hub portions 47 adjacent opposite ends for receiving and rotatably supporting the second carrier member on the sleeve. The hub portions 47 on the second carrier are spaced apart a distance slightly less than the spacing of the hub portions 46 on the first carrier member, to be received therebetween when the first and second carrier members are mounted on the sleeve as shown in FIG. 1. The sleeve has end portions that project outwardly from the drive members and which are rotatably supported in openings in the ends 31*c* of the carrier support bracket 31 as shown in FIG. 1.

The first carrier member 33 has first ladder support means 51 extending between the hubs 46 and spaced outwardly from the axis of the tilt rod. The first ladder support means 51 has a strip suspension edge 51*a* spaced a preselected distance from the axis of the tilt rod and a portion 51*b* that extends from the edge 51*a* and converges toward the sleeve. The strip suspension edge is preferably sufficiently long to support a ladder having wide tape side strips, it being understood that the tape suspension edge can also support ladders having narrow tape side strips as well as cord side strips. The second ladder carrier member 34 has a second ladder support means 52 that extends between the hubs 47 and is spaced a preselected distance outwardly from the tilt rod axis. The second ladder support means 52 has second strip suspension edge 52*a* that is spaced a preselected distance outwardly from the tilt rod axis, and a portion 52b that extends from the edge 52a and converges toward the sleeve 41.

Ladder carrier 33 has abutments 33a at opposite ends that extend into the path of movement of the drive lugs 45a on the drive members 43 and 44. The second ladder carrier member 34 has abutments 34a at opposite ends that are disposed in the path of movement of the drive lugs 45b on the drive members 43 and 44. The drive lugs 45a on the drive means 21 are arranged to engage abutments 33a on the first ladder carrier member 33, when the drive means is rotated in a first direction that is counterclockwise as viewed in FIGS. 2 and 3. Drive lugs 45b on the drive means 21 are arranged to engage the abutments 34a on the second carrier member 34, when the drive means is rotated in a second direction, that is clockwise as viewed in FIGS. 2 and 3. The abutments 33a are preferably disposed adjacent opposite ends of the strip suspension edge 51a and the abutments 34a are also preferably disposed adjacent opposite ends of the strip suspension edge 52a. Thus, when the drive means 21 is positioned as shown in FIG. 2 with the drive lugs 45a and 45b disposed in a generally horizontal plane, the abutments 33a and 34a will be supported on the drive lugs and the tape suspension edges 51a and 52a will also be disposed in a generally horizontal plane.

Figure 9:
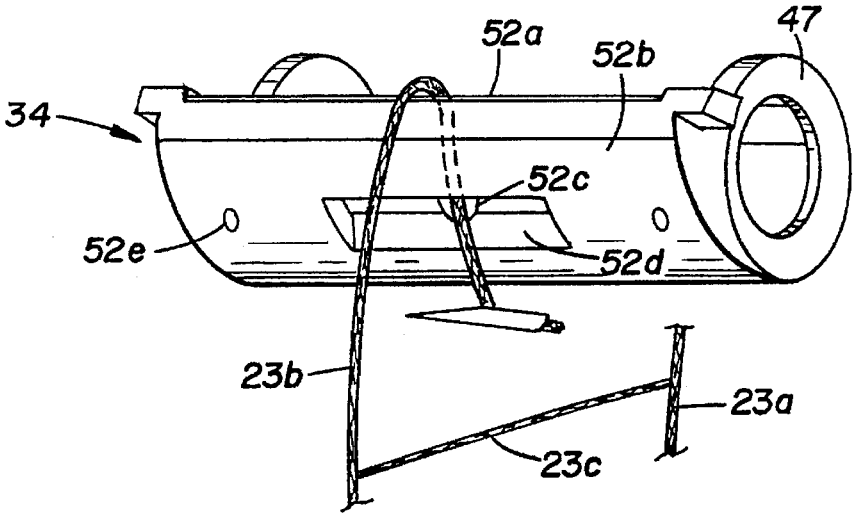
FIG. 9 is a perspective view illustrating attachment of a cord type side strip to one of the carrier members.
Figure 10:
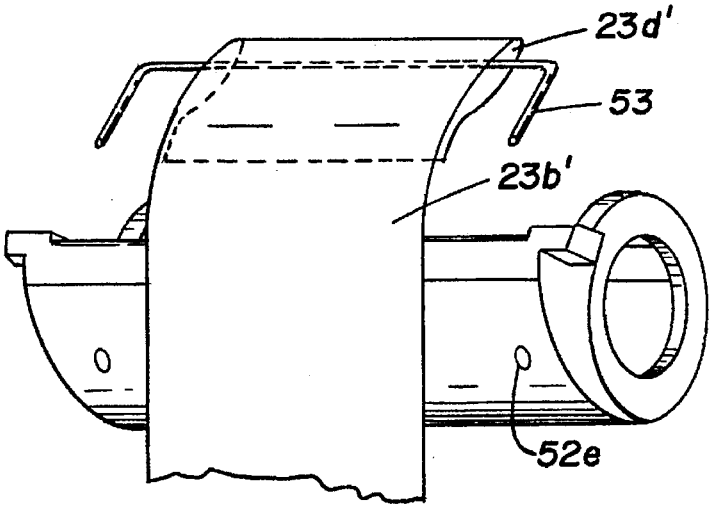
FIG. 10 is a perspective view illustrating attachment of a tape type side strip to one of the carrier members.
Figure 11:
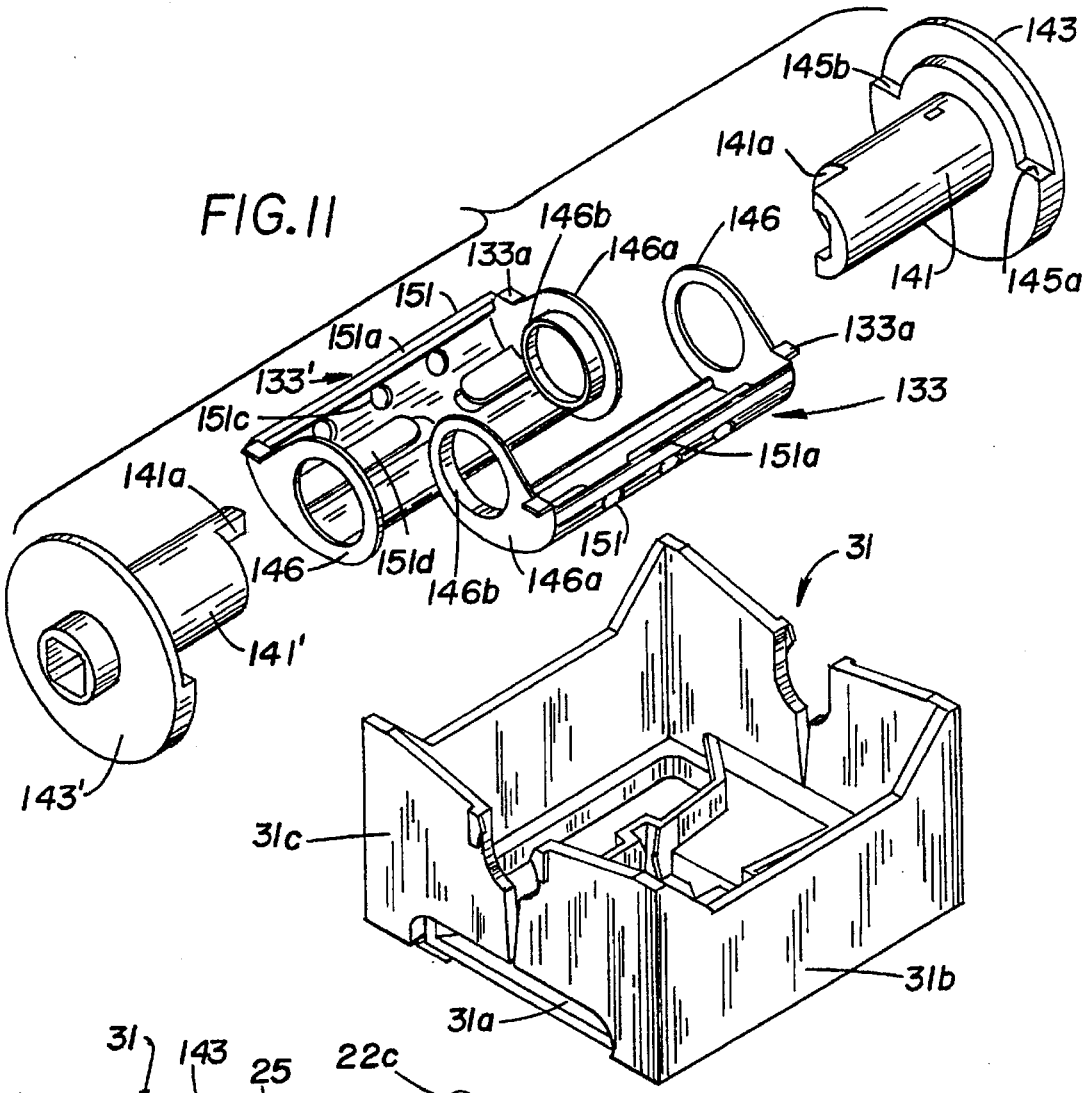
FIG. 11 is and exploded perspective view of a second embodiment of the ladder carrier mechanism.
Figure 12:
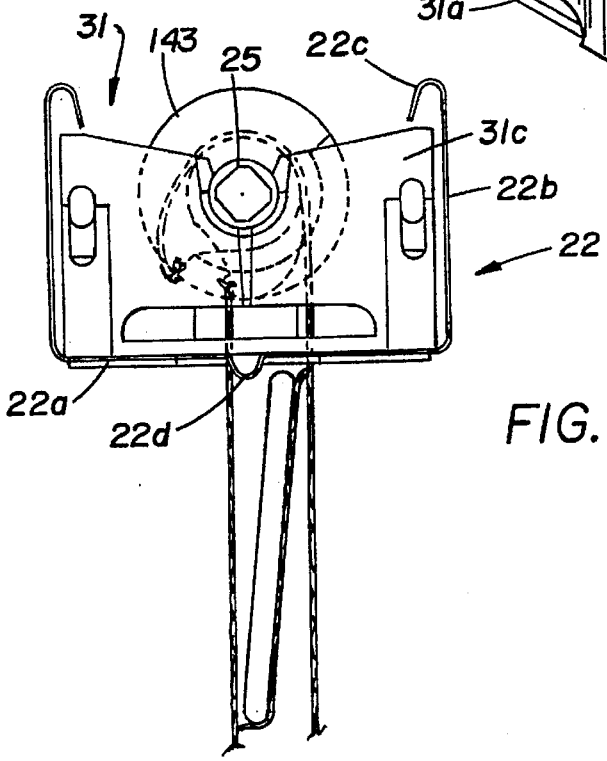
FIG. 12 is a vertical sectional view through the ladder carrier mechanism of FIG. 11.
Figure 13:
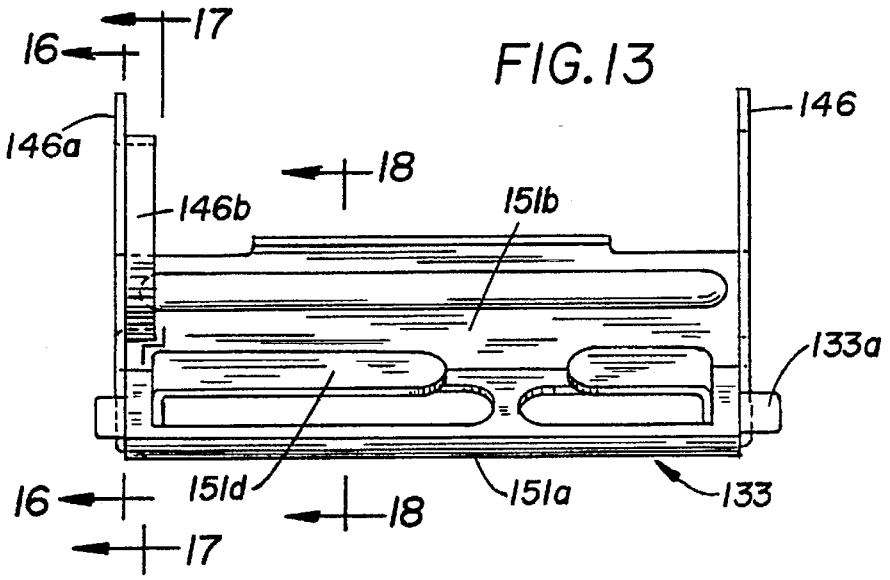
FIG. 13 is a side view of one of the ladder carriers.
Figure 14:
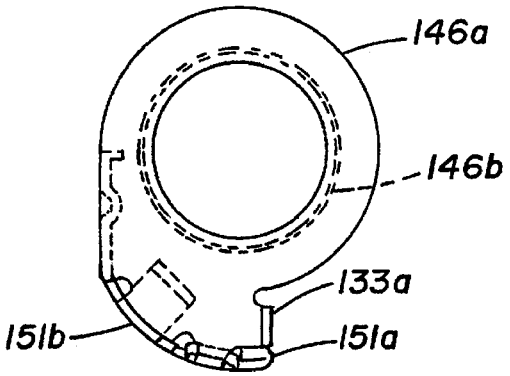
FIGS. 14 and 15 are end views of opposite ends of the ladder carrier of FIG. 13.
Figure 15:
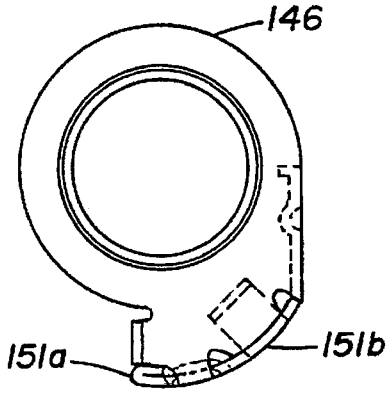
Figure 17:
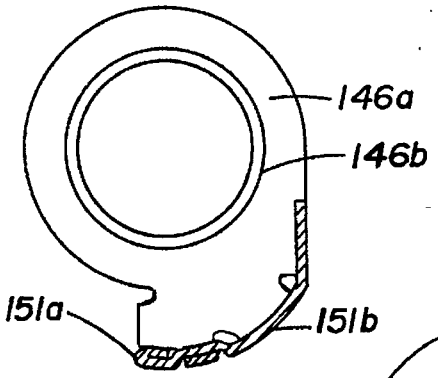
FIG. 17 is a sectional view taken on the plane 17—17 of FIG. 13.
Figure 16:
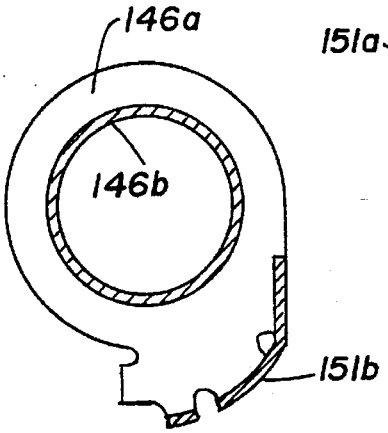
FIG. 16 is a sectional view taken on a plane 16—16 of FIG. 13.
Figure 18:
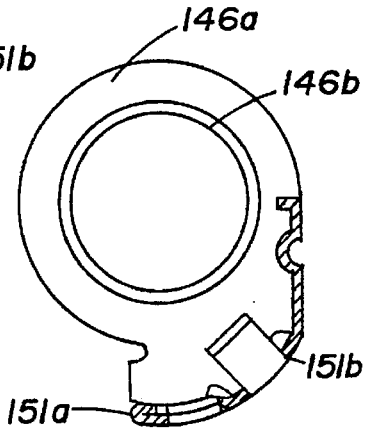
FIG. 18 is a sectional view taken on a plane 18—18 of FIG. 13.

Upper end portions of the side strips 23a and 23b of the slat support ladder 23 are mounted on the first and second carrier members respectively by extending the upper end portion of the side strips over the respective first and second tape support edges 51a and 52a, and attaching the ends to the portions 51b and 52b of the carrier members. As best shown in FIG. 5 and 9, the portion 52b of the second ladder support means is provided with an opening 52c approximately mid-way between the ends of the second carrier member and an end of a cord type side strip 23b can be inserted through the opening 52c, and a means such as a know or an end fitting 23d on the side strip can be provided for retaining of the cord against withdrawal from the opening 52c. As shown in FIG. 9, a recess 52d is preferably provided in the outer surface of the portion 52b to receive the fitting 23d. As shown in FIG. 6, the first ladder support means 51b is also provided with an opening 51c for receiving an end of a cord type side strip. Tape type side strips 23b' as shown in FIG. 10 can also be attached to the ladder carrier by providing a loop shown at 23d' in an end of the side strip and securing the end of the side strip to the ladder support means by a U-shaped bail 53 having end portions insertable into openings 52e and 51e, in the second and first slat carrier members 34 and 33 respectively.

The ladder carrier mechanism 21 is adapted to raise one of the side strips through a distance greater than the distance that the other side strip is lowered, during movement of the blind between an open condition as shown in FIG. 2 and a closed condition as shown in FIG. 3. More specifically, when the drive means 21 is rotated from the position shown in FIG. 2 in one direction, for example a counterclockwise direction, the drive lug 45a will engage abutment 33a and turn the first ladder carrier member 33 with the drive member in a counterclockwise direction while the other drive lug 45b moves in a counterclockwise direction away from the abutment 34b and allows the other side strip to move downwardly under the weight of the venetian blind supported on the side cords, until the abutment 34a reaches a bottom position. When the drive means is rotated further in a counterclockwise direction, drive lug 45b will move away from the abutment 34a while the other drive lug 45a continues to engage abutment 33a and rotate the first ladder carrier member. This causes the first side strip 23a of the ladder to wrap around as shown in FIG. 3 so that raising of the side strip 23a continues. In the position shown in FIG. 3, the drive member has been rotated through an angle of about 270 degrees. If the drive member is rotated further, it will continue lifting the side strip 23a until the edge of the upper slat substantially contacts the under side of the headrail. The ladder carrier mechanism 21 operated in a similar manner when drive means is rotated in a clockwise direction from a blind an open to a blind closed condition. A downwardly projecting longitudinal light block rib 22d is advantageously provided on the bottom of the headrail along a vertical plane containing the tilt rod axis to cooperate with the top slat to block passage of light between that slat and the bottom of the headrail when the blind is closed in either direction. The headrail 22 shown is formed of metal and the light block rib 22d is conveniently formed by depressing a longitudinal channel in the bottom when forming the headrail.

A second and presently preferred embodiment of the invention is illustrated in FIGS. 11–18. Like numerals are used to designate the same parts as in the first embodiment, and like numerals in the hundred series are used to designate modified parts. As in the preceding embodiment, a carrier support bracket 31 is mounted in a headrail 22 and a ladder carrier mechanism 132 is disposed in the support bracket means and rotatably supported on end walls of the bracket means.

In this embodiment, a sleeve means is formed in two half-sections 141 and 141', each having a polygonal opening therethrough for non-rotatably receiving tilt rod 25. Adjacent end portions of the sleeve sections are preferably interleaved as shown at 141a in FIG. 11 to assure rotation of the sleeve half-sections in substantial unison. A drive member 143, 143' is formed integrally with each sleeve section, and each drive member has drive lugs 145a and 145b angularly spaced apart approximately 180 degrees.

First and second ladder carrier members 133 and 133' have the same configuration and are arranged to be assembled in endwise reversed relation to each other. The ladder carrier members each have hubs 146 and 146a adjacent opposite ends and ladder support means 151 that extend between the hubs and are spaced outwardly from the tilt rod axis.

The carrier members are preferably formed of sheet metal and, in order to reduce abrasion of the sleeve sections 141, and 141', a bushing 146b is provided on or formed integral with one of the hubs 146a. The inner side of the bushing 146b is dimensioned to rotatably receive the sleeve sections 141a and 141b and the inner opening in the other hub 146 is dimensioned to rotatably extend around the outer side of the bushing 146b. With this arrangement, the first and second carrier members can be assembled in endwise inverted relation with the hub 146 on one carrier member extending around the bushing 146b on the other carrier members. The sleeve half-sections can then be inserted into the hubs from opposite directions and the drive mechanism and carrier members then assembled on the carrier support bracket 31. End portions of the sleeves 141a and 141b extend outwardly of the drive members 143 and 143' and are rotatably supported in saddles on the ends of the carrier support bracket 31. The drive members 143, 143' are, disposed inside the end walls of the carrier support bracket and the drive members and first and second carrier member are retained in assembled relation by the support bracket. The carrier member 151 and 151' each have a strip suspension edge 151a and abutments 133a that extend outwardly from opposite of the carrier members ends for engagement with drive lugs 145*a*, 145*b* on the drive members. The abutments 133*a* on the carrier member 133 are arranged to engage the drive lugs 145*a*, and the abutments 133*a* on the carrier member 133' are arranged to engage the drive lugs 145*b* on the drive members. Drive lugs 145*a* are arranged to engage abutments 133*a* on carrier member 133 when the drive members are rotated in a first direction, counterclockwise as viewed in FIG. 12, and drive lugs 145*b* are arranged to engage abutments 133*a* on the carrier member 133', when the drive means is rotated in the opposite direction, clockwise as viewed in FIG. 12. As in the preceding embodiment, the strip suspension edges 151*a* are spaced radially from the tilt rod axis a distance equal to or slightly less than one-half the width of the slats, to support upper portions of the side strips 23*a* and 23*b* at a shallow angle to the vertical in the blind open position as shown in FIG. 2, and the carrier members have portions 151*b* that extend from the associated strip suspension edge 151*a* in a direction opposite the direction of rotation by the drive means and in a manner that converges toward the outer surface of the sleeve means so that the carrier members have a maximum radial dimension adjacent the strip suspension edge and a minimum radial dimension at about 90 degrees from the strip suspension edge. The portions 151*b* of the carrier support members have one, or more openings 151*c* (FIG. 11) for use in anchoring or retaining end portions of ladders having cord type side strips. The portions 151*b* also have deformable tabs 151*d* for use in anchoring end portions of ladders having wide tape or band type side strips.

From the foregoing it is believed that the construction and operation of the ladder carrier mechanism will be readily understood. When the drive means is in a position as shown in FIG. 2 with the drive lugs in a generally horizontal plane, the drive lugs engage the abutments on the ends of the carrier members and support the carrier members with the tape suspension edges in a horizontal plane. The strip suspension edges are spaced radially from the axis of the tilt rod a distance to support the upper portions of the side strips 23*a* and 23*b* of the ladder so that the upper portions deviate only a small angle and preferably less than 10 degrees from the vertical, to avoid causing the upper slat to hang-up in a tilted or canted position, when the blind is moved from a closed condition as shown in FIG. 3 to an open condition. The portions 151*b* of ladder support members 151 converge toward the sleeve in a direction opposite the direction in which the carrier members are drivingly rotated by the drive means, so that the side strips 23*a* and 23*b* of the ladder can move closer to each other when the ladder carrier mechanism is operated to close the slats. When the drive mechanism is rotated in a direction to drive the carrier member associated with one of the side strips such as 23*a*, the driven carrier will continue to lift the associated side strip after the strip support edge passes a top dead center position while the carrier associated with the other side strip such as 23*b*, will move downwardly only until the tape support edge on the other carrier approaches a bottom dead center position as shown in FIG. 3. This arrangement has several advantages. It reduces the overall headrail height required to accommodate movement of the ladder carrier mechanism between a blind open position and a blind closed position, so that the headrail can have a height substantially less than the width of the slats. Further, since the ladder carrier mechanism lifts one of the side strips through a greater distance than it allows lowering of the other side strip, it enables the upper slat to be drawn close to the underside of the headrail to minimize the light gap between the slats and headrail in a closed condition. The ladder carrier mechanism also reduces the space between the side strips 23*a* and 23*b* when in a closed condition, to reduce light leakage between the slats.

The embodiments of the invention in which an exclusive property or privilege is claimed are defined as follows:

1. In a venetian blind having a headrail, a tilt rod selectively rotatable the tilt rod in opposite directions about a tilt rod axis, flexible ladder means including a pair of flexible side strips joined by cross rungs for supporting slats ladder carrier mechanism for connecting the ladder means to the tilt rod for operation thereby, and carrier support bracket means in the headrail, the improvement wherein the ladder carrier mechanism comprises:

(a) drive means connected to the tilt rod for turning therewith about the axis of the tilt rod, (b) first and second carrier members supported for turning relative to the drive means and relative to each other about the axis of the tilt rod, the first and second carrier members respectively having first and second ladder support means spaced outwardly from the axis of the tilt rod, (c) means connecting one of the side strips to the first ladder support means, means connecting the other of the side strips to the second ladder support means, (d) means on the drive means for driving the first carrier member in a first angular direction when the drive means is rotated in the first angular direction by the tilt rod, and means on the drive means for driving the second carrier member in a second angular direction when the drive means is rotated in said second angular direction by the tilt rod.

2. A venetian blind according to claim 1 wherein the ladder rungs have preselected a length for supporting a slat, the first and second ladder support means respectively having first and second tape suspension edges spaced from the tilt rod axis a distance less than one-half the length of the rungs.

3. A venetian blind according to claim 2 wherein the distance between a bottom of the headrail and a top thereof is less than the length of the rungs.

4. In a venetian blind having a headrail, a tilt rod selectively rotatable in opposite directions about a tilt rod axis, flexible ladder means including a pair of flexible side strips joined by cross rungs for supporting slats, ladder carrier mechanism for connecting the ladder means to the tilt rod for operation thereby, and carrier support bracket means in the headrail, the improvement wherein the ladder carrier mechanism comprises:

(a) drive means connected to the tilt rod for turning therewith about the axis of the tilt rod, (b) first and second carrier members supported for turning relative to the drive means and relative to each other about the axis of the tilt rod, the first and second carrier members respectively having first and second ladder support means spaced outwardly from the axis of the tilt rod, (c) means connecting one of the side strips to the first ladder support means and means connecting the other of the side strips to the second ladder support means, (d) the drive means having first and second drive lugs angularly spaced apart about 180 degrees, the first carrier member having first abutment means in the path of the first drive lug when the drive means is rotated in said first direction, the second carrier member having a second abutment means in the path of movement of the second drive lug when the drive means is rotated in said second direction.

5. A venetian blind according to claim 4 wherein one first ladder support means has a first strip suspension edge and the second ladder support means has a second strip suspension edge, said first abutment means is located on the first carrier member adjacent an end of the first strip suspension edge and the second abutment means is located on the second carrier member adjacent an end of the second strip suspension edge.

6. A venetian blind according to claim 5 wherein the ladder rungs have a preselected length for supportomg a slat, the first and second strip suspension edges being spaced from the tilt rod axis a distance less than one-half the length of the rungs.

7. A venetian blind according to claim 6 wherein the distance between a bottom of the headrail and the top thereof is less than the length of the rungs.

8. In a venetian blind having a headrail, a tilt rod selectively rotatable in opposite directions about a tilt rod axis, flexible ladder means including a pair of flexible side strips joined by cross rungs for supporing slats, ladder carrier mechanism for connecting the ladder means to the tilt rod for operation thereby, and carrier support bracket means in the headrail, the improvement wherein the ladder carrier mechanism comprises:

(a) drive means connected to a tilt rod for turning therewith about the axis of the tilt rod, (b) first and second carrier members supported for turning relative to the drive means and relative to each other about the axis of the tilt rod, the first and second carrier members respectively having first and second ladder support means spaced outwardly form the axis of the tilt rod, (c) means connecting one of the side strips to the first ladder support means and means connecting the other of the side strips to the second ladder support means, (d) the drum drive means including sleeve means having passage means therethrough for non-rotatably receiving the tilt rod and drive members extending outwardly adjacent opposite ends of the sleeve means, the first and second carrier members being disposed between the drive members and each carrier member having hub means adjacent opposite ends for supporting the associated carrier member for turning relative to the sleeve means and relative to each other.

9. A venetian blind according to claim 8 wherein at least one of the drive members has first and second drive lugs rotatable therewith and angularly spaced apart about 180 degrees, the first carrier member having first abutment means in the path of movement of the first drive lug when the drive means is rotated in a first direction, and the second carrier member having second abutment means disposed in the path of movement of the second drive lug when the drive means is rotated in said second direction.

10. A venetian blind according to claim 9 wherein the first ladder support means has a first strip suspension edge and the second ladder support means has a second strip suspension edge, said first abutment means being located on the first carrier member adjacent an end of the first strip suspension edge, the second abutment means being located on the second carrier member adjacent an end of the second strip suspension edge.

11. A venetian blind according to claim 10 wherein the ladder rungs have a preselected length for supporting a slat, the first and second strip suspension edges being spaced from the tilt rod axis a distance less than one-half the length of the ladder rungs.

12. A venetian blind according to claim 11 wherein the distance between a bottom of the headrail and a top thereof is less than the length of the ladder rungs.

13. A venetian blind according to claim 10 wherein the drive means is operable to drive the first carrier member in said first angular direction through an angle substantially greater than 180 degrees and the drive means is operable to drive said second carrier member in said second angular direction through an angle substantially greater than 180 degrees.

14. A venetian blind according to claim 13 wherein said first ladder support means has a portion that extends from the first tape suspension edge in a direction opposite said one direction and converges toward an outer surface of the sleeve means, said second ladder support means having a portion that extends from the second tape suspension edge in a direction opposite said second direction and converges toward an outer surface of the sleeve means.

15. A venetian blind according to claim 8 wherein the said sleeve means has end portions rotatably supported on the carrier support bracket means.

16. A venetian blind according to claim 8 wherein the sleeve means and a first one of the drive members are formed in one-piece, a second one of the drive members being detachably and non-rotatably mounted on he sleeve means.

17. A venetian blind according to claim 8 wherein said sleeve means includes a first sleeve portion formed integral with a first one of the drive members, a second sleeve portion formed integral with a second one of the drive members.

18. A venetian blind according to claim 8 wherein first and second carrier members have the same configuration.

19. A venetian blind according to claim 1 wherein the headrail has means providing a downwardly projecting sight block rib on a bottom of the headrail along a vertical plane containing the tilt rod axis.

* * * * *